United States Patent [19]

von Matern et al.

[11] 4,254,944

[45] Mar. 10, 1981

[54] FRAMEWORK FOR A BASKET FOR HEAT TREATING AT HIGH TEMPERATURES, AND A METHOD FOR MANUFACTURING THE SAME

[75] Inventors: Sten von Matern; Rune Ö. W. Fredriksson, both of Avesta, Sweden

[73] Assignee: Avesta Jernverks Aktiebolag, Sweden

[21] Appl. No.: 9,921

[22] Filed: Feb. 7, 1979

[30] Foreign Application Priority Data

Feb. 10, 1978 [SE] Sweden ..... 7801597

[51] Int. Cl.[3] ..... C21D 1/00

[52] U.S. Cl. ..... 266/275; 228/184

[58] Field of Search ..... 266/275, 276, 277; 228/184

[56] References Cited

U.S. PATENT DOCUMENTS 2,294,044 8/1942 Nielsen ..... 266/275

*Primary Examiner*—R. Dean

[57] ABSTRACT

The basket framework is comprised of U-shaped members having large radius bends forming the bottom and sides of the basket without requiring welds between bottom and side members to provide a flexible structure very resistant to damage from repeated thermal expansion and contraction.

12 Claims, 2 Drawing Figures

Figure 1:
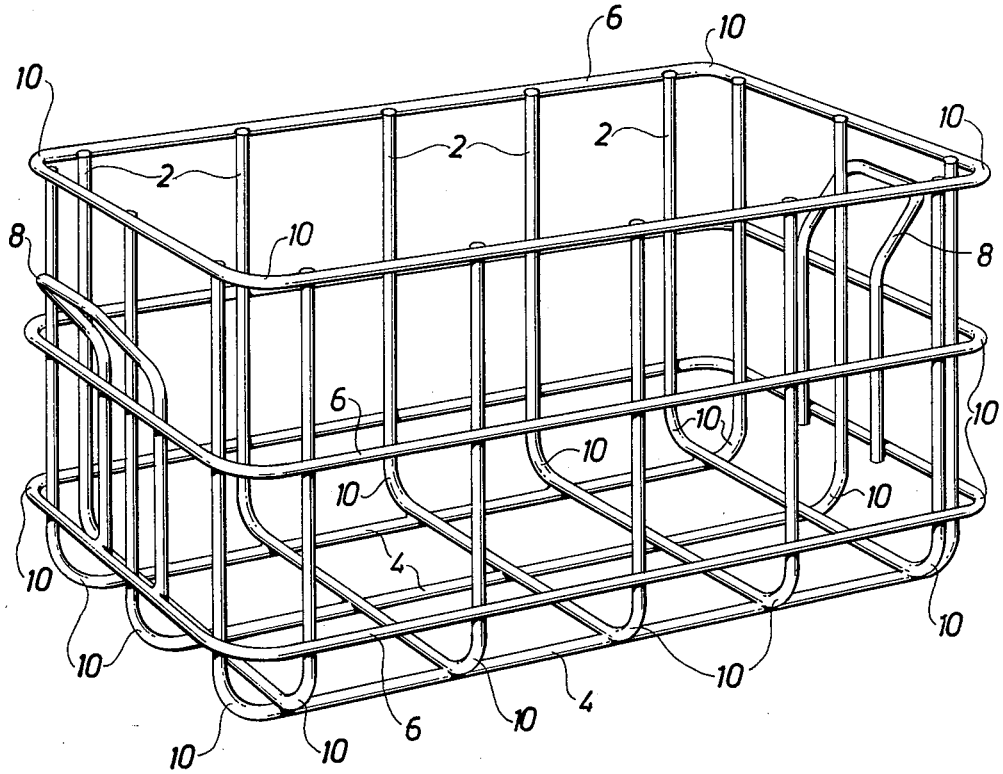

FRAMEWORK FOR A BASKET FOR HEAT TREATING AT HIGH TEMPERATURES, AND A METHOD FOR MANUFACTURING THE SAME

The present invention relates to a framework for a basket for heat treating at high temperatures, e.g. annealing, metal piece goods or the like, said framework being assembled by a plurality of bars of heat resistant metal mutually crossing each other in the bottom and all side walls of said framework. The invention also relates to a method for manufacturing the basket framework.

Besides baskets of cast iron or sheet metal which are very clumsy and heavy, there have also been known for a very long time baskets having a lattice framework welded of metal bars. The framework encloses said basket which is made of braided metal wires.

The manufacture of such an earlier framework starts with a number of said bars cut to a length determined by the length, width and height, respectively, of the desired framework. These bars are welded together along the edges of the framework as well as at crossings in the side walls and the bottom. Such a framework accordingly will have welded joints along all its edges, besides the welds at the locations where the bars cross each other within the walls. It has turned out that one serious weakness of these frameworks is the welds along the edges between the side walls and the side walls and the bottom. These welds break due to the fact that they are exposed to bending stresses when the side walls and bottom are deformed by the temperature variations during the heat treating process. This is particularly true at deeper baskets where also other welds of the framework can break due to the thermal stresses.

Attempts to solve the problem earlier have mainly included solutions making the frameworks as rigid as possible to minimize the thermal movements at the welds. This has i.a. been attained by means of diagonal members and/or by using as said bars enforcing angle irons at least partly. Despite such measures the frameworks normally become unusable due to deformations and broken joints after only a few months of normal operation, and then have to be taken out of operation for repair.

The main purpose of the invention is to provide a framework having a longer life of operation than has been possible heretofore.

According to the invention all side walls, and all side walls and the bottom, of the framework are mutually flexibly interconnected. This solution implies a complete deviation from the above discussed earlier principles of framework design, since the invention is based upon the new thought that the framework structure instead of being as rigid as possible should be flexible and movable in all sides.

Extensive tests have revealed that frameworks according to the invention possess a life of operation that is many times that of earlier frameworks. Frameworks according to the invention are also lighter since they need fewer and thinner bars in their structure and are also easier to manufacture since fewer welds are needed.

The method according to the invention comprises the steps of cutting and bending a plurality of first and second, respectively, metal bars into U-shaped sections with the length of the base portions corresponding to the desired width and length, respectively, of the framework and with a large radius of curvature between the base and leg portions of the U, cutting a plurality of further metal bars to form bar sections having the width and length, respectively, of the framework, arranging said first, second and further sections in a fixture with the plane of said first and second sections, respectively, extending transversely to each other and the further sections being arranged over each other in planes extending transversely to the sides of the first and second sections so that the leg portions of the U-shaped sections are included in the side walls of the framework, and the bars of the further sections cross said leg portions, and welding at crossings between the different sections.

Figure 2:
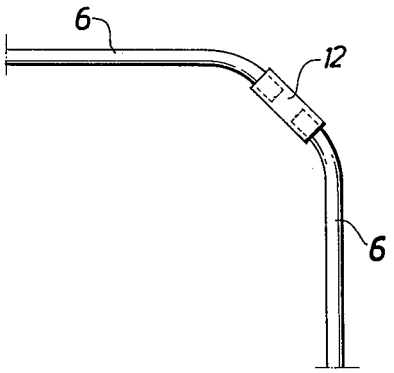

The invention will now be described more closely below while referring to the attached drawing, on which FIG. 1 illustrates a perspective view of a framework for a basket for heat treating at high temperatures, and FIG. 2 is a part of such a basket for illustrating a modification.

The framework shown on the drawing includes five U-shaped round bar sections 2. The length of the base portions of the sections 2 is determined by the width of the framework. Furthermore the framework includes three U-shaped round bar sections. The length of the base portions of the sections 4 is determined by the length of the framework. The height of the sections 2 and 4 is determined by the height of the framework and the sections 2 are arranged perpendicularly to and within the sections 4 as illustrated.

The sections 2 and 4 are furthermore surrounded by three generally rectangularly shaped round bar sections 6 which are spot welded to the sections 2 and 4 at a number of crossing points with these, possibly at all crossing points. The sections 2 and 4 are furthermore mutually joined by spot welding at a number of crossings in the bottom of the basket, possibly at all crossings.

Handle bars 8 having the illustrated shape are spot welded to the two lower ones of the sections 6 at the short side walls of the framework.

A distinguishing feature of the basket framework is that all its side walls, and the side walls and the bottom, are mutually joined by means of portions 10 of the round bars with a great large radius of curvature.

The basket framework as shown is manufactured by cutting and bending the sections 2, 4, and 6 from whole lengths of round bar. At the sections 6 thereupon the mutually meeting and contacting ends are joined by means of flash-but welding. All the sections are then introduced into a fixture, a so called template basket, in which the spot welding is carried through at a desired number of crossing points. Preferably one then begins with the crossing points heated nearest the portions 10, whereby the welding of the crossing points within the side walls and the bottom is made easier. The fixture is thereupon removed and the handles 8 are finally welded in place.

To give a background to the difficulties discussed initially an example is here given of the dimensions and design of a basket framework according to the invention:

Length = 780 mm
Width = 480 mm
Height = 415 mm
Radius of curvature between the sides and between the sides and the base = 50 mm Bar Diameter = 16 mm
Steel Avesta 253 MA.

This framework can be used for a basket of braided metal wire with a wire thickness of 3.0 mm and size of mesh of 10 mm, and outer dimensions of approximately 750×450×400 mm. The steel is also here Avesta 253 MA, e.g. extended metal. Also at the basket the edges are preferably made rounded. The basket is fastened into the framework by means of lashing.

The framework according to the invention is completely free from the weaknesses which have appeared in earlier frameworks with welded edges. Furthermore also the stresses on the spot welds between the sections 2, 4 and 6 are reduced since the flexibility of the basket along the edges is increased due to the shape of these with great radius of curvature. The stated advantages become particularly apparent with deeper baskets, i.e. baskets with high side walls, e.g. side walls the height of which is of the same order of magnitude as the width of the framework. In such baskets the welds in prior art construction had a very short useful life. The invention also resides in the discovery that it permits, partly due to the absence of edge bars and thus edge welds, that all welds can be made by means of spot welding, whereby the welding takes a shorter time and the welds become stronger. Furthermore spot welds give maximum mobility to the welded parts as compared with fillet welds, so that the welds become less sensitive to thermal movements of the parts.

The invention is not necessarily limited to the embodiment as illustrated and described but can be modified within the scope of the claims. Thus the number of sections 2, 4 and 6 can e.g. be varied and they can be mutually arranged in another way, e.g. with the sections 4 within the section 2 and/or the sections 6 within the sections 2 and 4. The shape and location of the handles 8 can also be varied as required. Instead of round bars, bars with e.g. square, oval, or octagonal section can be used. In particular, bars with oval section have turned out to be very advantageous, since the spot welding process becomes easier and the basket may be made still lighter, if the oval section is optimally dimensioned with regard to the expected load conditions, the smaller dimension of the oval extending transversely to the wall of the framework. If straight bars are included in the side walls of the bottom no welds are made at the edges of the framework, but their ends are accordingly allowed to move freely.

In order to increase the capability for relative movement at certain edges further the bar portions with a large radius of curvature can at least partly be replaced by connecting elements, which interconnect meeting bar ends while permitting a considerable relative movement between them. An example is illustrated in FIG. 2, where the free ends of the round bar portions 6 extend slidably into a connecting element in the form of a tube 12, which permits relative movement between portions 6. This embodiment will be particularly suitable at the edges joining the sides of the basket.

It should furthermore be noted that the stresses upon the joints, e.g. the welds, are minimized if all metal bars in the framework have the same dimensions of their cross sections.

Regarding the joints at the crossing points these can possibly be made by means of rivetting. The rivets can then be introduced with some play in the section bars.

What we claim is:

1. A framework for a basket for heat treating articles such as metal parts at high temperatures comprising a plurality of bars of heat resistant metal mutually crossing each other to form the bottom wall and side walls of said framework, and flexible interconnections between the mutually adjacent edges of said respective walls, said flexible interconnections comprising curved bars of heat resistant metal having a large radius of curvature arranged in spaced relationship along said mutually adjacent edges.

2. A framework as claimed in claim 1 wherein said curved bars comprise extended portions of said bars forming said walls.

3. A framework as claimed in claim 2 comprising a plurality of essentially U-shaped bars wherein the base portions of said U-shaped bars comprise the bars forming said bottom wall of said framework, the leg portions of said U-shaped bars comprise at least some of the bars forming the side walls of said framework, and the portions of said U-shaped bars interconnecting said base portions and said leg portions comprise said extended portions of said bars forming said curved bars having a large radius of curvature.

4. A framework as claimed in claim 3 wherein said framework comprises generally rectangular shaped bar frames, the respective sides of said rectangular bar frames form horizontal bars of the respective side walls of the framework, and the portions of said rectangular bar frames interconnecting said horizontal bars of said side walls comprise said extended portions forming said curved bars having a large radius of curvature.

5. A framework according to claim 4, in which said U-shaped bars and said rectangular bar frames are each integrally formed in one piece.

6. A framework according to any one of the claims 5, 1, 2, 3, or 4, in which joints between the bars crossing within each wall are in the form of spot welds.

7. A framework according to claim 2 wherein the curved bars having a large radius of curvature are connected between the bottom wall and the side wall bars, whereas the bars of the side walls meeting each other are interconnected by means of tubes, in which they slidably extend.

8. A framework according to any one of the claims 5, 7, 1, 2, 3, or 4 wherein the metal bars have an oval cross section, the smallest dimension of the oval extending transversely to the wall in which the respective bars are located.

9. A framework according to one of the preceding claims 5, 7, 1, 2, 3, or 4 wherein all metal bars have the same dimensions of their cross sections.

10. A method of manufacturing a framework for a basket for heat treating articles such as metal parts at high temperatures, comprising the steps of cutting and bending a plurality of first and second, respectively, metal bars into U-shaped sections with the length of the base portions corresponding to the desired width and length, respectively, of the framework and with a large radius of curvature between the base and leg portions of the U, cutting a plurality of further metal bars to form bar sections having the width and length, respectively, of the framework, arranging said first, second and further sections in a fixture with the plane of said first and second sections, respectively, extending transversely to each other and the further sections being arranged over each other in planes extending transversely to the sides of the first and second sections so that the leg portions of the U-shaped sections are included in the side walls of the framework, and the bars of the further sections cross said leg portions, and welding at crossings between the different sections.

11. A method according to claim 10 wherein the welding is carried through by means of point welding, crossings located nearest the edges of the framework being welded first.

12. A method according to claim 10 or 11, comprising forming the further sections in one piece with a large radius of curvature at each corner of the framework between adjacent side walls.

* * * * *